US006715396B2

(12) United States Patent
Dionne

(10) Patent No.: US 6,715,396 B2
(45) Date of Patent: Apr. 6, 2004

(54) FIREARM CONVERSION KIT

(75) Inventor: Sylvain Dionne, Mirabel (CA)

(73) Assignee: SNC Technologies Inc., Le Gardeur (CA)

( * ) Notice: Subject to any disclaimer, the term of this patent is extended or adjusted under 35 U.S.C. 154(b) by 4 days.

(21) Appl. No.: 10/362,759

(22) PCT Filed: Aug. 30, 2001

(86) PCT No.: PCT/CA01/01249

§ 371 (c)(1),
(2), (4) Date: Feb. 26, 2003

(87) PCT Pub. No.: WO02/18863

PCT Pub. Date: Mar. 7, 2002

(65) Prior Publication Data

US 2003/0177896 A1 Sep. 25, 2003

(30) Foreign Application Priority Data

Aug. 30, 2000 (CA) ..... 2317084

(51) Int. Cl.[7] ..... F41A 9/00; F41A 9/16

(52) U.S. Cl. ..... 89/33.2; 42/49.02; 89/33.14; 89/33.16; 89/33.25

(58) Field of Search ..... 89/33.2, 33.14, 89/33.16, 33.25, 34, 33.1; 42/49.02

(56) References Cited

U.S. PATENT DOCUMENTS 418,040 A * 10/1889 Green ..... 89/33.2
1,354,825 A * 10/1920 Menneking et al. ..... 89/33.2
2,383,830 A * 8/1945 Trotter et al. ..... 89/33.16
2,418,462 A * 4/1947 Chadwick et al. ..... 42/18
2,840,944 A * 7/1958 Thompson
2,870,561 A * 1/1959 Colby ..... 42/18
2,889,750 A * 6/1959 Colby ..... 89/33.2
3,000,126 A * 9/1961 Robinson ..... 42/18
3,000,265 A * 9/1961 Robinson ..... 89/33.2
3,130,638 A * 4/1964 Horton, Jr. et al. ..... 89/33.1
3,452,640 A * 7/1969 Maillard ..... 89/33.2
3,507,185 A * 4/1970 Schuetz ..... 89/33.2
3,596,557 A * 8/1971 Henshaw ..... 89/33.2
4,777,752 A * 10/1988 Howard ..... 42/50
6,345,562 B1 * 2/2002 Mannhart ..... 89/33.16
6,588,312 B2 * 7/2003 Murello et al. ..... 89/197

OTHER PUBLICATIONS

US Army: "Field manual 23–14: M249 light machine gun in the automatic rifle role" Jan. 26, 1994, Headquarters Department of the Army, Washington XP002187461 p. 3–2, Line 1–8; figure 3–2.*

* cited by examiner

*Primary Examiner*—Michael J. Carone
*Assistant Examiner*—Lulit Semunegus
(74) *Attorney, Agent, or Firm*—David J. French

(57) ABSTRACT

A cartridge feed tray for belt ammunition is modified to receive shorter ammunition and exclude ammunition of standard length by inclusion of an insert positioned along the forward containment wall of the tray. The insert carries a feed lip that fits through a loading port orifice in the feed tray to direct shorter ammunition downwardly as it is being advanced towards the weapon breach for loading.

10 Claims, 7 Drawing Sheets

FIREARM CONVERSION KIT

FIELD OF THE INVENTION

This Invention relates to the field of firearms and provisions for modifying automatic firearms for training purposes. In particular, it relates to automatic gas-operated weapons adapted to fire reduced-energy ammunition in a blow-back mode and to training ammunition for use therein.

BACKGROUND TO THE INVENTION

Reduced-Energy Ammunition for Training Purposes

In military and police firearms applications almost all of the ammunition consumed is used for training. For some training purposes, however, standard (service) ammunition is inappropriate. An alternative type of training ammunition, represented by U.S. Pat. No. 5,359,937 (adopted herein by reference) fires a low-mass projectile relying on a telescopically-expanding, reduced-energy cartridge designed to provide blow-back cycling of suitable modified, recoil-operated or gas-operated automatic weapons.

Advantages of the reduced-energy ammunition are that it has a shorter range and lower penetration capacity than standard ammunition. This permits the use of smaller, less secure firing ranges, even improvised ranges, as training facilities. However, if standard ammunition were accidentally employed in such facilities, unexpected dangers would arise from its increased striking power and range.

Appropriate modifications to certain semi-automatic and automatic weapons allow normal weapon functioning, including recoil, through a pure blow-back action when firing such training ammunition. Such a system, when firing low mass marking cartridges, for example, allows effective close-range, force-on-force training. Tactical scenarios that can be effectively simulated include counter-terrorism, close quarters combat, trench clearing, fighting in wooded areas, urban fighting, room clearing, dynamic entries, and protection of dignitaries.

Confidence is gained because the training ammunition/conversion kit system allows the trainees to use their own service weapons during stressful exercises that involve shooting and being shot at under realistic tactical situations. The training is safe when properly conducted, but there is a pain penalty for participants who are hit. It is the fear of this penalty that encourages the participants to treat the training scenarios as "the real thing" and to behave as though their lives were at risk.

Modification to Weapon to Permit Firing of Reduced-Energy Ammunition

When firing standard ammunition with its abundant associated energy, it is necessary in many weapons to lock the barrel to the slide (for pistols) or to the bolt/bolt carrier assembly (for gas-operated rifles or machineguns) during the beginning of the firing action for a period long enough for the bullet to exit the barrel muzzle while the breech is still closed. This allows the chamber pressure to drop before the breech opens to extract and eject the spent cartridge case. A locking mechanism couples the barrel to the slide or bolt/bolt carrier assembly for the first portion of the discharge, and then releases the slide or bolt/bolt carrier assembly, usually with the aid of a cam. Upon unlocking, the slide or bolt/bolt carrier assembly continues its rearward travel until, after the spent cartridge case has been ejected, it returns under the influence of the recoil spring to receive and chamber the next round from the magazine en route to its in-battery position.

In a training system such as described above there is not enough energy in the reduced-energy cartridges to precipitate sufficient recoil to unlock the barrel from the slide or bolt/bolt carrier assembly in their standard configurations. It is necessary, therefore, to omit the barrel locking mechanism and, by so doing, the recoil action becomes blow-back of the slide or bolt/bolt carrier assembly only.

The modifications to a semi-automatic pistol, for example, to permit normal functioning when firing reduced-energy ammunition as represented by U.S. Pat. No. 5,359,937 generally include replacing or modifying the barrel and sometimes replacing or adding one or two other components, depending on the weapon involved. In a gas-operated weapon, the bolt is prevented from rotating so that it will not engage the cam in the barrel extension. In both instances, the modifications result in a pure blow-back action of the weapon upon firing reduced energy ammunition which is sufficient to cycle the weapon in a normal fashion.

Problem of Feeding in Automatic Weapons

In some instances the external configuration of the reduced-energy ammunition is not identical to that of the equivalent standard ammunition. This is the case with 5.56 mm reduced-energy ammunition as represented by U.S. Pat. No. 5,359,937, which may be shorter and have a different weight than the standard 5.56 mm cartridge, as well as having a head end of smaller diameter.

In weapons such as, for example, the 5.56 mm Fabrique Nationale (FN) "Minimi" machinegun or the similar 5.56 mm US M249 Light Support Weapon, linked ammunition is fed into the chamber via a feed tray followed by a feed ramp. Should shorter than normal ammunition, such as the above training ammunition, be fed into the normal feed tray and said feed ramp, chambering of the ammunition may not proceed smoothly. There is the possibility of one or more cartridges skewing in the normal tray or ramp, both of which are too large to ensure the proper feeding of said ammunition.

This is important in training systems utilizing reduced-energy ammunition because the training projectile is often more fragile that the standard one. If the feeding is not true and the cartridge skews slightly prior to entering the chamber, the tip of the projectile is not strong enough to resist being damaged with the result that the weapon may jam. A first objective of the present invention is, therefore, to provide a solution to this problem by allowing the feeding and chambering of reduced-energy ammunition to proceed normally during full automatic firing of a machinegun such as the M249.

Problem of Live-Fire Exclusion

The conversion of 9 mm pistols to allow them to function normally when firing reduced-energy ammunition generally involves replacing the standard barrel by a training barrel. To ensure that a live service cartridge cannot be chambered in a converted weapon, the caliber of the training projectile and the training barrel are intentionally made smaller than 9 mm. Hence, a live round cannot chamber properly in a weapon converted for training because its projectile is too big to fit into the bore of the training barrel, and the weapon would jam.

The same approach could be taken for 5.56 mm gas-operated semi-automatic rifles and fully automatic machineguns by changing the barrel in the upper receiver barrel assembly and altering the bolt in the bolt carrier assembly to remove the locking mechanism. While such a design would ensure the exclusion of live service ammunition from being fired from a converted weapon, it would also be costly to implement and awkward for the user due to the excessive number of weapon components involved.

An alternative approach is to modify only the bolt/bolt carrier assembly, leaving untouched the upper receiver barrel assembly and the lower receiver buttstock assembly. In this way, the weapon can be rapidly and conveniently converted to fire reduced-energy training ammunition by simply exchanging the service bolt/bolt carrier assembly for a training bolt/bolt carrier assembly. This means, however, that live service ammunition would not be excluded from chambering in the standard 5.56 mm barrel. The possibility that a standard round can be fired from a converted weapon is not acceptable from a safety point of view.

It is, therefore, a second objective of the invention to provide a solution to this safety problem by preventing a live 5.56 mm cartridge from reaching the chamber of the standard barrel in the upper receiver barrel assembly of a machinegun such as the M249. By so doing, safe firing of training ammunition training in a converted weapon of this type can be conducted while positively excluding the firing of a live round of service ammunition should one (or more) be inadvertently inserted into the links feeding the weapon during training or practice sessions The invention in its general form will first be described, and then its implementation in terms of specific embodiments will be detailed with reference to the drawings following hereafter. These embodiments are intended to demonstrate the principal of the invention and the manner of its implementation. The invention in its broadest and more specific forms will be further described and defined in each of the individual claims that conclude the specification.

SUMMARY OF THE INVENTION

The invention is preferably directed to gas-operated automatic machineguns, as typified by the M249 Light Support Weapon, that are adapted to fire reduced-training ammunition as represented by U.S. Pat. No. 5,359,937.

According to one aspect of the invention a feed tray for supplying belt ammunition cartridges to an automatic firearm is provided that comprises:

(a) a tray support surface (b) forward and rearward ammunition containment side walls mounted along opposite sides of said tray support surface (c) a loading port orifice at the end of the forward containment wall through which cartridges may be advanced (d) a feed lip positioned above the loading port orifice along the forward containment wall, outwardly from the tray support surface whereby ammunition being fed through such tray and outwardly through the loading port orifice is guided in its advancement through said orifice by the feed lip. Optionally, the feed lip may be carried by an insert that is coupled to the feed tray, as by attachment to the forward ammunition containment side wall.

According to another aspect of the invention a feed tray for supplying belt ammunition cartridges to an automatic firearm is provided that comprises:

(a) a tray support surface (b) forward and rearward ammunition containment side walls mounted along opposite sides of said tray support surface- and (c) a training cartridge guide surface located along the inner side of the forward containment wall to reduce the distance between said containment walls to substantially the length of training ammunition cartridges to be passed through said tray for firing, which cartridges are shorter that standard ammunition in their length.

This training cartridge guide surface may be provided by a thickened forward ammunition containment wall as an integral part of such wall; or it may be provided by an insert coupled to such wall, as by fasteners, welding or an interfitting shape that allows the insert to engage with such wall.

As an example of an interfitting shape the insert may include a wall portion with a groove positioned and dimensioned to receive and interfit with the upper edge of the forward containment wall to fix the insert in place on the feed tray.

Optionally, such insert may carry the feed lip for positioning above the loading port orifice along the forward containment wall, outwardly from the tray support surface, whereby ammunition being fed through such tray and outwardly through the loading port orifice will be guided in its advancement through said orifice by the feed lip.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
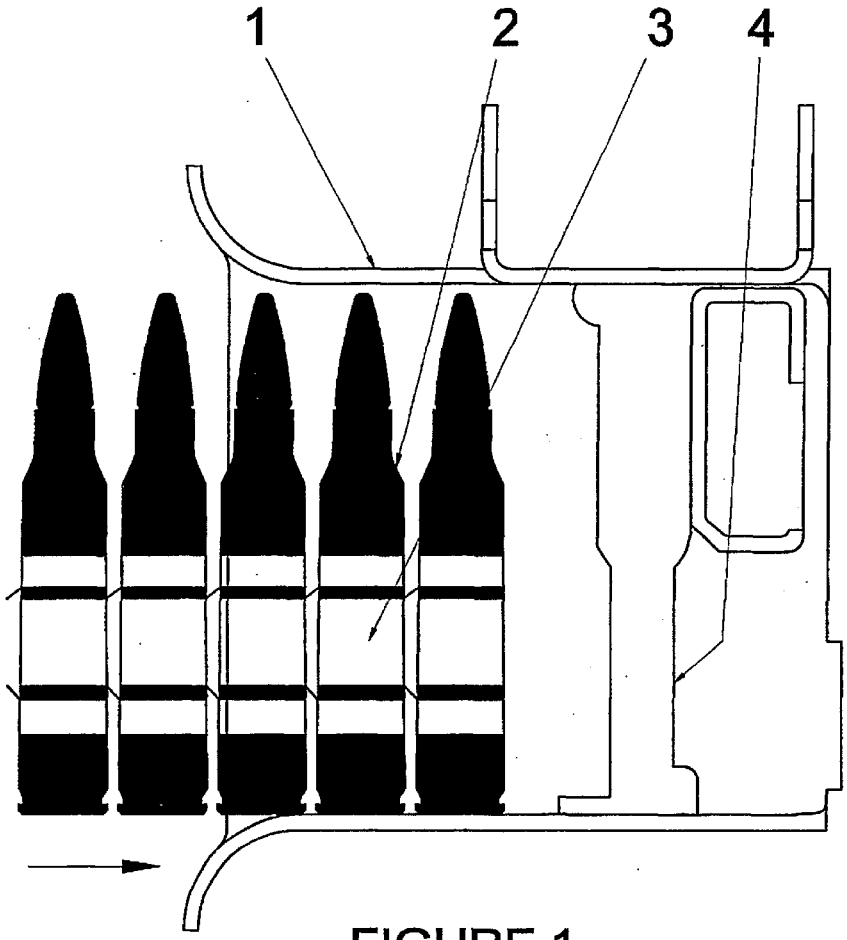
FIGURE 1 PRIOR ART
FIG. 1 is a top view of a prior art feed tray for a 5.56 mm Minimi or M249 automatic machinegun shown with prior art 5.56 mm linked service ammunition being fed through it before being picked up by the bolt and drawn down into the breech en route to the chamber.
Figure 2:
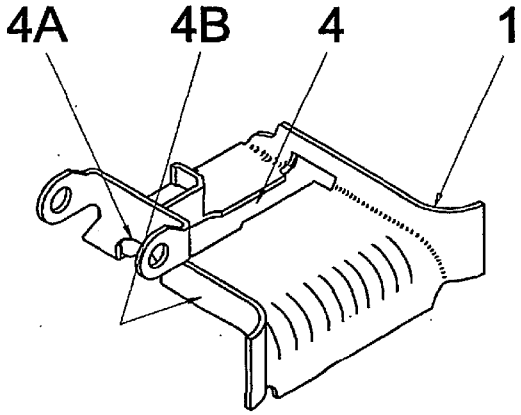
FIGURE 2 PRIOR ART
FIG. 2 is a schematic representation of the prior art feed tray of FIG. 1.

FIG. 1 is the top view of a service feed tray 1 normally mounted on an FN Minimi machinegun or US M249 Light Support Weapon with a belt of service 5.56 mm ball ammunition 2 being fed through it over the tray support surface 1A, by service links 3. Forward 4B and rearward 4C ammunition containment side walls are mounted along opposite sides of the tray support surface 1A. When each cartridge 2 arrives above loading port 4 it is removed from its link 3 by the weapon's bolt (not shown) and pulled downwards through loading port 4. Links 3 are discarded to the right of the feed tray 1. For clarity, there is no round of ammunition in the loading port, nor are empty links shown to extend over and beyond the loading port as they would normally do during firing. FIG. 2 illustrates the structure of service feed tray 1 in a three-dimensional view highlighting loading port 4, exist orifice 4A and side wall 4B.

Figure 3:
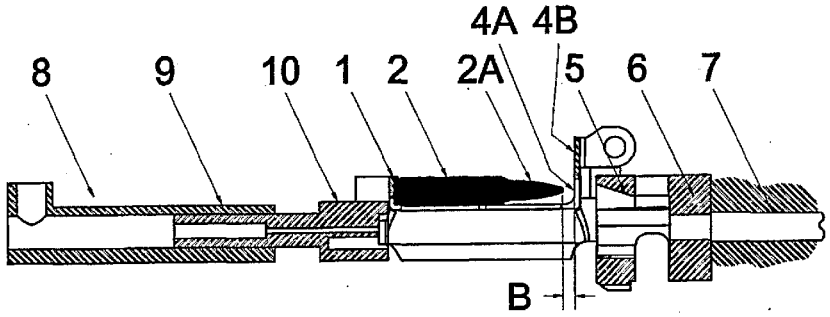
FIGURE 3 PRIOR ART
FIG. 3 is a side view cross-section of the prior art feed tray of FIGS. 1 and 2 as assembled in a prior art Minimi or M249 machinegun.

FIG. 3 is a side view cross section of service feed tray 1 of FIGS. 1 and 2 as assembled in a service Minimi or M249 machinegun (not shown) with a service cartridge 2 positioned directly above loading port 4 (better seen in FIGS. 1 and 2). Service bolt/bolt carrier assembly 8, service bolt carrier 9, a service 5.56 mm cartridge 2 in said service feed tray 1, service barrel extension 6 containing feed ramp 5 and service barrel 7 complete the assembly. Service cartridge 2 is shown in feed tray 1 occupying substantially the distance between containment walls 4B, 4C just before being picked up by service bolt 10 after the weapon has been fired.

Figure 4:
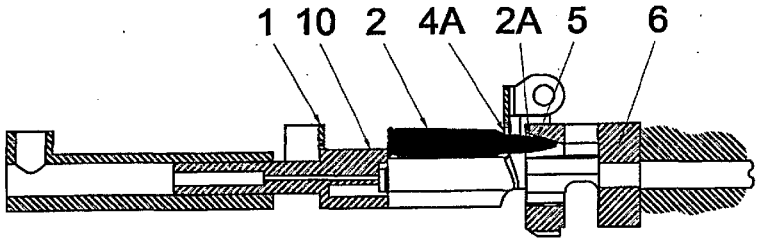
FIGURE 4 PRIOR ART
FIG. 4 is the same as FIG. 3 except the bolt has moved forward slightly to pick up the cartridge to the extent that the tip of the cartridge is entering the feed ramp of the barrel extension.
Figure 5:
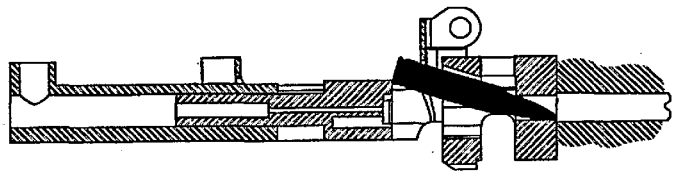
FIGURE 5 PRIOR ART
FIG. 5 is the same as FIGS. 3 and 4 except the bolt is even farther forward with the cartridge proceeding normally downward through the feed ramp of the barrel extension and into the chamber.
Figure 6:
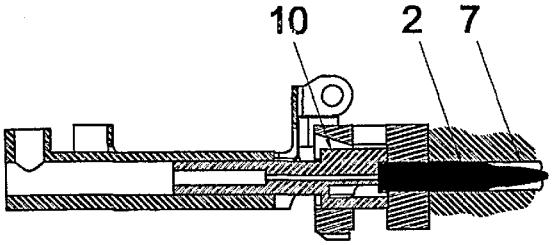
FIGURE 6 PRIOR ART
FIG. 6 is the same as FIGS. 3, 4 and 5 except the bolt is now in its forward most position and the cartridge is fully chambered and ready for firing.

FIG. 4 is the same as FIG. 3 except that service cartridge 2 has now been moved slightly forward by service bolt 10, as the firing cycle progresses. Service projectile 2A of service cartridge 2 has cleanly passed through exit orifice 4A of service feed tray 1 to enter feed ramp 5 of service barrel extension 6. FIGS. 4 through 6 depict the continued progress of service cartridge 2 through feed ramp 5 and service barrel extension 6 until properly chambered in service barrel with service bolt 10 in its forward most position ready for firing.

Figure 7:
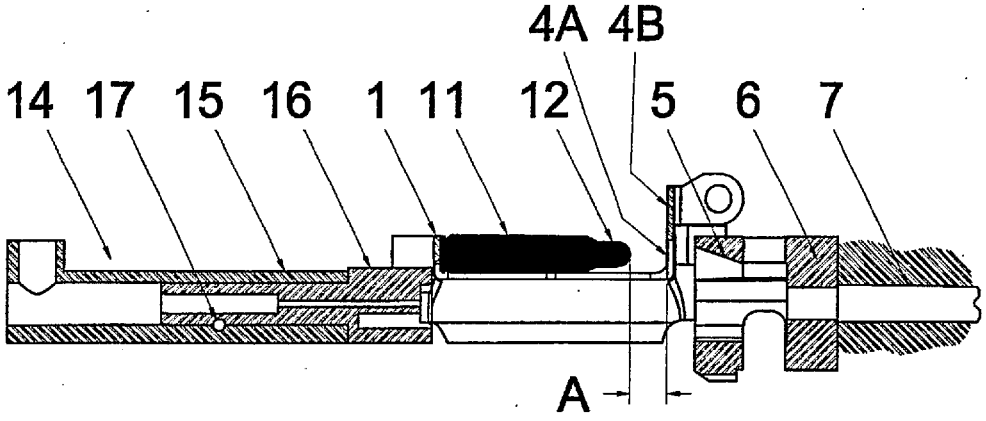
FIG. 7 is the same as FIG. 3 except the cartridge shown is a training cartridge as represented by U.S. Pat. No. 5,359,937, which is shorter than the standard 5.56 mm cartridge. That is, the training cartridge is shown being fed into the machinegun through a prior art service feed tray.

FIG. 7 is the same as FIG. 3 except that service cartridge 2 has been replaced in service feed tray 1 by a 5.56 mm reduced energy training cartridge 11, as represented by U.S. Pat. No. 5,359,937. In order to fire such training ammunition in weapons such as the FN Minimi or the US M249 machineguns, it is necessary to convert the weapon to pure blow back action. This is done by uncoupling the locking mechanism that holds the service bolt/bolt carrier assembly 8 to the service barrel 7 and disconnecting the gas recoil system (not shown). Thus, the assembly of FIG. 7 comprises training bolt/bolt carrier assembly 14, training bolt carrier 15, training bolt 16 and training pin 17.

Figure 8:
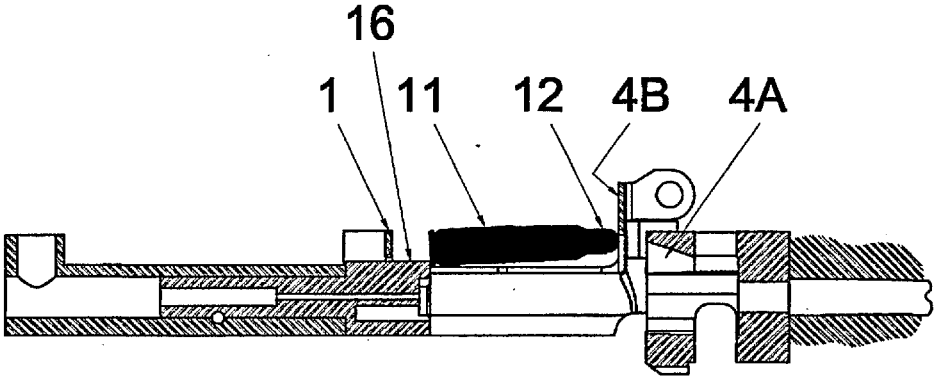
FIG. 8 is the same as FIG. 7 except the bolt has moved forward slightly to pick up a training cartridge to the extent that the tip of the cartridge is at the entrance to the feed ramp, but not cleanly entering onto the feed ramp.
Figure 9:
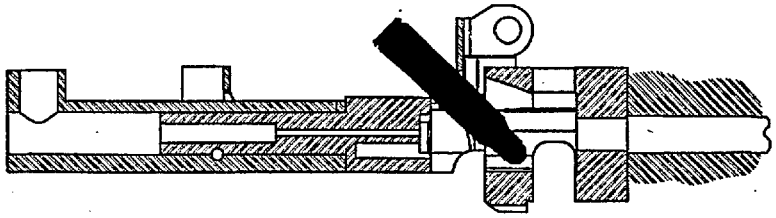
FIG. 9 is the same as FIGS. 7 and 8 except the bolt is still farther forward, the cartridge has not properly entered the feed ramp, and the weapon has jammed.

In this configuration, however, the distance "A" between the tip of training projectile 12 and side wall 5B of service feed tray 1 is appreciably greater than the similar distance "B" between the tip of the service projectile 2A and said side wall 4B of said feed tray 1 in FIG. 3. There is, therefore, freedom for training cartridge 11 to skew somewhat after being removed from service link 3. As a result, when training bolt 16 picks up training cartridge 11, said training cartridge 11 frequently does not pass cleanly through exit orifice 4A, but rather catches on its edge 4B as depicted in FIG. 8. This results in a weapon jam, as illustrated in FIG. 9.

Figure 10:
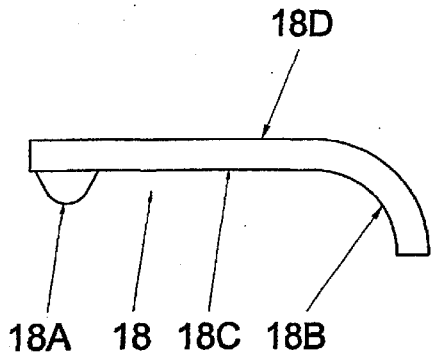
FIG. 10 is a top view of a training insert of the invention for combination with a standard feed tray.
Figure 10A:
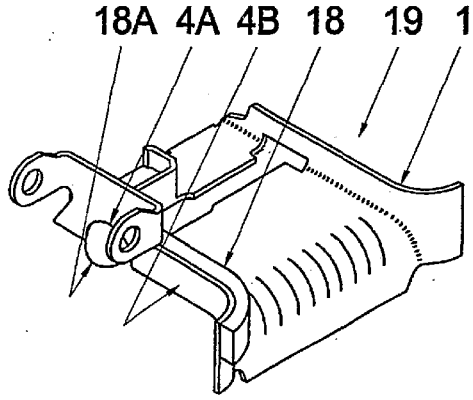
FIG. 10A is the same representation of the feed tray as in FIG. 2 except the training insert of FIG. 10 has been added. With the addition of the insert, it becomes a training feed tray.

FIG. 10 shows a training insert 18 of the invention comprising feed lip 18A, curved wall 18B and straight wall 18C, the tray-side portion of which serves as a training cartridge guide surface 18D. The shape of said training insert 18 is such that curved wall 18B and straight wall 18C fit snugly against the inside of side wall 4B of service feed tray 1 and feed lip 18A extends outwardly and downwardly through exit orifice 4A as depicted in FIG. 10A. Training insert 18 may be permanently attached to service feed tray 1 in a variety of mechanical ways to form training feed tray 19, eg as by screws, bolts or the like. The preferred method of this invention is to weld the two pieces together. Insert 18 may also be extended forwardly along a portion of its top surface and be slotted on the underside of the extension to fit over containment wall 4B as described further below. Or it may be integrally formed with the feed tray 1 to provide the training cartridge guide surface 18D.

Figure 11:
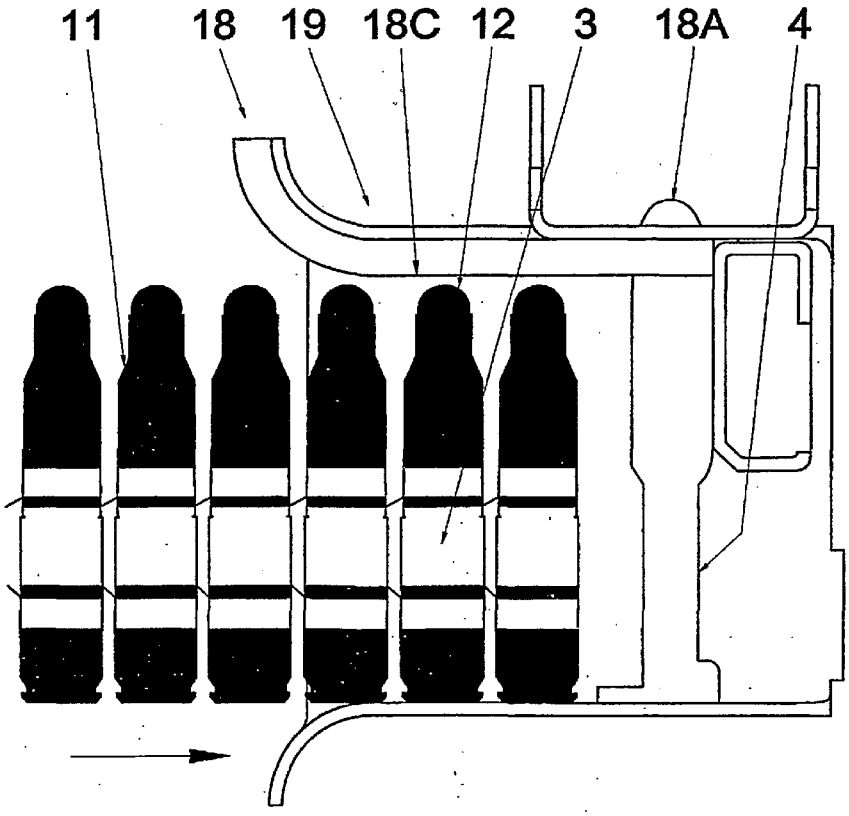
FIG. 11 is a top view of a training feed tray for a 5.56 mm Minimi or M249 automatic machinegun shown with 5.56 mm linked training ammunition being fed through it before being picked up by the training bolt and drawn down into the breech en route to the chamber. For clarity, there is no round of ammunition in the loading port, nor are empty links shown to extend over and beyond the loading port as they would normally do during firing.

FIG. 11 is the same as FIG. 1 except that service cartridges 2 have been replaced by training cartridges 11 and service feed tray 1 has been replaced by training feed tray 19. In this configuration, there is no longer any space between the tip of training projectile 12 and side wall 18C of training insert 18 for training cartridge 11 to move unduly. In addition, feed lip 18A offsets the difficulty of the shorter training cartridge 11 to reach feed ramp 5 by bridging the gap between exist orifice 4A and the entrance to said feed ramp 5, as illustrated in FIG. 12.

Figure 12:
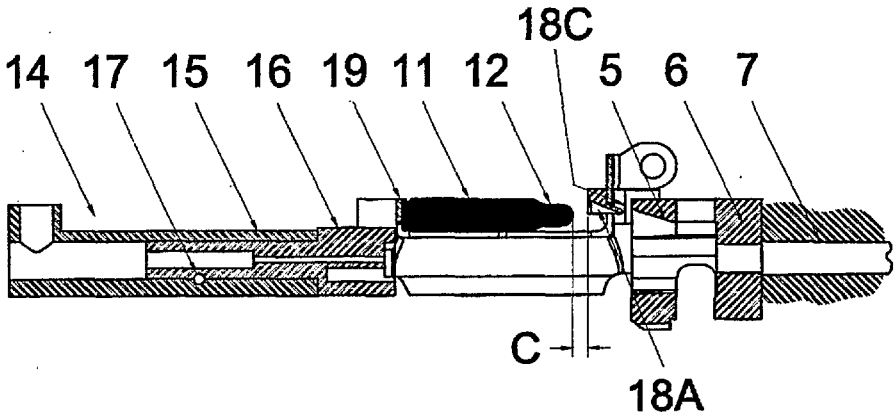
FIG. 12 is a side view cross-section of the training feed tray of FIG. 10 as assembled in a prior art Minimi or M249 machinegun showing a training bolt/bolt carrier assembly, a 5.56 mm training cartridge in the training feed tray, a prior art barrel extension and a prior art barrel. The training cartridge is shown in the training feed tray just before being picked up by the training bolt for chambering.

FIG. 12 is the same as FIG. 7 except that training feed tray 19 has replaced service feed tray 1. The presence of training insert 18 eliminates the possibility of excess movement of training cartridge by reducing the distance between the tip of training projectile 12 and straight side wall 18C of training insert 18 to the minimum required for proper feeding of the linked ammunition. That is, distance "C" of FIG. 12 for the firing of training ammunition is essentially the same as distance "B" of FIG. 3 for the firing of service ammunition. This means that training cartridge 11 will pass unimpeded through exit orifice 4A of training feed tray 19.

Figure 13:
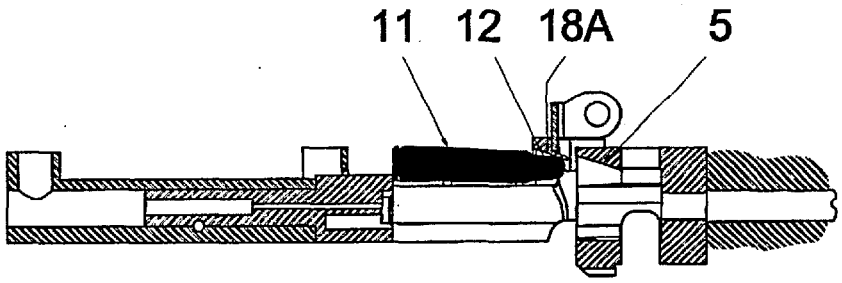
FIG. 13 is the same as FIG. 12 except the training bolt has moved forward slightly to pick up the training cartridge to the extent that the tip of the training cartridge is entering the feed lip of the training inset.
Figure 14:
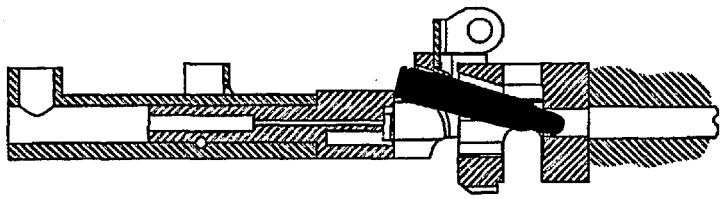
FIG. 14 is the same as FIGS. 12 and 13 except the training bolt is even farther forward with the training cartridge proceeding normally downward through the feed ramp of the barrel extension.
Figure 15:
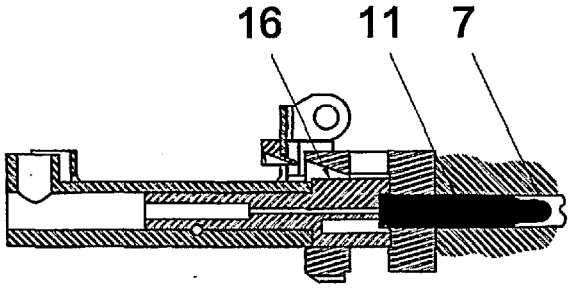
FIG. 15 is the same as FIGS. 12, 13 and 14 except the training bolt is now in its forward most position and the training cartridge is fully chambered and ready for firing.

Once safely through exit orifice 4A, however, the tip of training projectile 12 is too far away from the entrance to feed ramp 5 of service barrel extension 6 to ensure reliable chambering without the presence of feed lip 18A of training insert 18. As shown in FIG. 13, said feed lip 18A guides training cartridge 11 so that training projectile 12 cleanly enters feed ramp 5. FIGS. 14 and 15 depict the continued progress of training cartridge 11 through feed ramp 5 and service barrel extension 6 until properly chambered in service barrel 7 with training bolt 19 in its forward most position ready for firing.

It is, therefore, an objective of this invention to encourage normal feeding of training cartridges 11 when fired in FN Minimi or US M249 machineguns by using training feed tray 19 in place of service feed tray 1. Preferably, said training feed tray 19 becomes an integral part of the conversion kit that permits said training cartridges to be fired reliably from said Minimi and M249 machineguns. Other components of the conversion kit include, but are not restricted to, training bolt/bolt carrier assembly 14, training bolt carrier 15, training bolt 16 and training pin 17.

Figure 16:
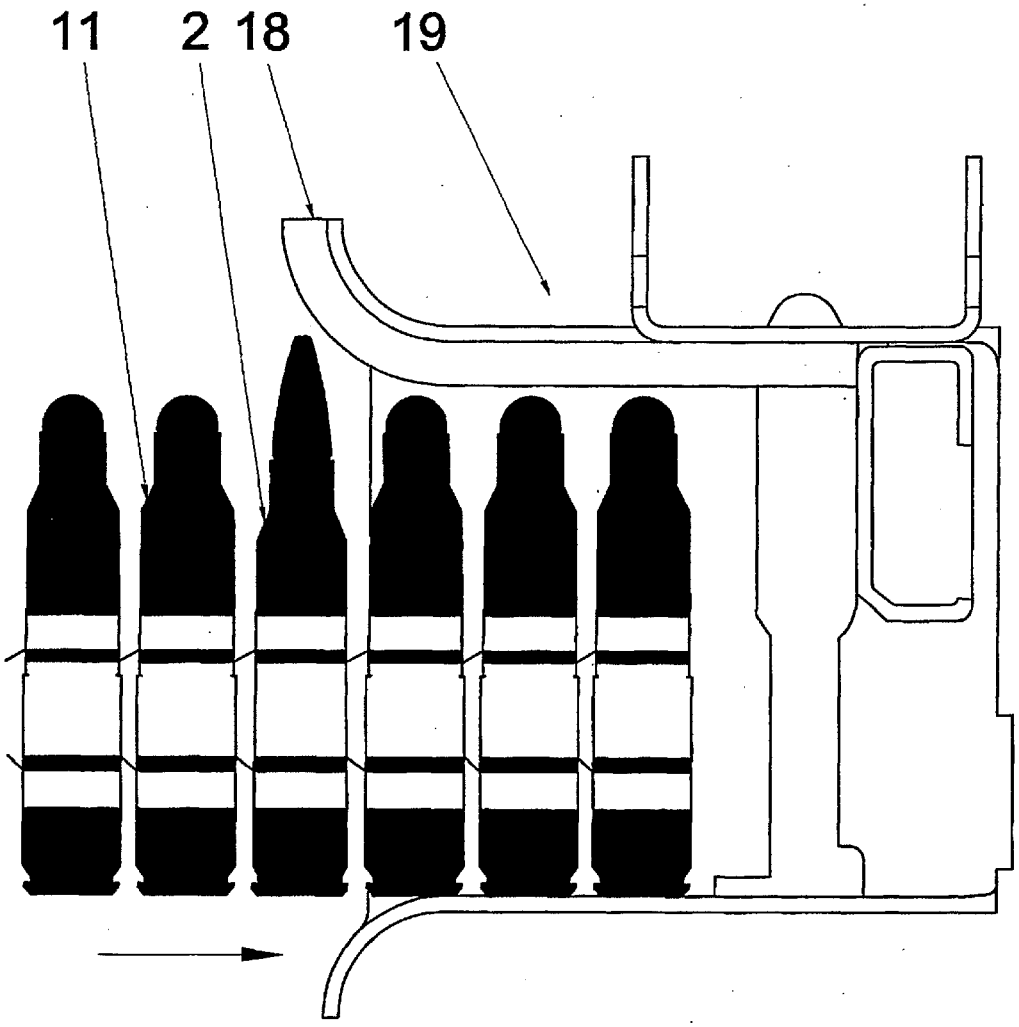
FIG. 16 is a top view of a training feed tray for a 5.56 mm Minimi or M249 automatic machinegun shown with 5.56 mm linked training ammunition being fed through it before being picked up by the training bolt and drawn down into the breech en route to the chamber. In the belt of ammunition leading into the feed tray, but not yet having reached it, is one 5.56 mm service cartridge. For clarity, there is no round of ammunition in the loading port, nor are empty links shown to extend over and beyond the loading port as they would normally do during a firing.

FIG. 16 is similar to FIG. 11 except the linked ammunition, which should consist only of training cartridges 11, inadvertently also contains one service cartridge 2. If service cartridge 2 were to chamber and be fired during a force-on-force training session, for example, it could inflict serious damage on unsuspecting targets, including human beings. As can be seen in FIG. 16, this cannot occur because the presence of training insert 18 in training feed tray 19 blocks passage of service cartridge 2, such blockage leading to subsequent jamming of the weapon. Such a blockage will alert the user to the possibility of other service cartridges being present as well as demanding a review of the safety procedures associates with the preparation of ammunition belts containing training ammunition.

It is, therefore, a second objective of this invention to provide a live-fire exclusion mechanism during training operations with reduced-energy cartridges 11. The presence of the training feed tray 19 positively prevents a service cartridge 2 from even commencing the chambering process, hence rendering the converted Minimi or M249 machineguns safe to use during training sessions.

FIG. 12 is the same as FIG. 7 except that training feed tray 19 has replaced service feed tray 1. The presence of training insert 18 eliminates the possibility of excess movement of training cartridge by reducing the distance between the tip of training projectile 12 and straight side wall 18C of training insert 18 to the minimum required for proper feeding of the linked ammunition. That is, distance "C" of FIG. 12 for the firing of training ammunition is essentially the same as distance "B" of FIG. 3 for the firing of service ammunition. This means that training cartridge 11 will pass unimpeded through exit orifice 4A of training feed tray 19.

Once safely through exit orifice 4A, however, the tip of training projectile 12 is too far away from the entrance to feed ramp 5 of service barrel extension 6 to ensure reliable chambering without the presence of feed lip 18A of training insert 18. As shown in FIG. 13, said feed lip 18A guides training cartridge 11 so that training projectile 12 cleanly enters feed ramp 5. FIGS. 14 and 15 depict the continued progress of training cartridge 11 through feed ramp 5 and service barrel extension 6 until properly chambered in service barrel 7 with training bolt 19 in its forward most position ready for firing.

It is, therefore, an objective of this invention to encourage normal feeding of training cartridges 11 when fired in FN Minimi or US M249 machineguns by using training feed tray 19 in place of service feed tray 1. Thus, said training feed tray 19 becomes an integral part of the conversion kit that permits said training cartridges to be fired reliably from said Minimi and M249 machineguns. Other components of the conversion kit include, but are not restricted to, training bolt/bolt carrier assembly 14, training bolt carrier 15, training bolt 16 and training pin 17.

FIG. 16 is a similar to FIG. 11 except the linked ammunition, which should consist only of training cartridges 11, inadvertently also contains one service cartridge 2. If service cartridge 2 were to chamber and be fired during a force-on-force training session, for example, it could inflict serious damage on unsuspecting targets, including human beings. As can be seen in FIG. 16, this cannot occur because the presence of training insert 18 in training feed tray 19 blocks passage of service cartridge 2, such blockage leading to subsequent jamming of the weapon. Such a blockage will alert the user to the possibility of other service cartridges being present as well as demanding a review of the safety procedures associated with the preparation of ammunition belts containing training ammunition.

It is, therefore, a second objective of this invention to provide a live-fire exclusion mechanism during training operations with reduced-energy cartridges 11. The presence of the training feed tray 19 positively prevents a service cartridge 2 from even commencing the chambering process, hence rendering the converted Minimi or M249 machineguns safe to use during training sessions.

Figure 17:
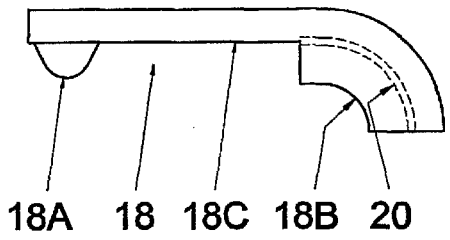
FIG. 17 is a top view of a variant of the training insert of FIG. 10 redesigned with a portion with a thicker wall having a slot formed in such thicker wall to fit over the top edge of the forward side wall of the tray.
Figure 18:
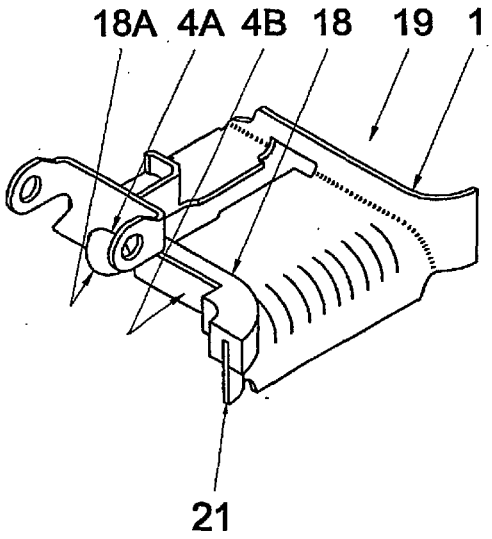
FIG. 18 is a perspective view of a training feed tray fitted with a slotted insert as in FIG. 17.

FIGS. 17 and 18 depict a further variant of the invention wherein the insert 18 has a widened curved portion 18B which has a slot 20 on its underside surface. This slot 20 fits over the curved portion 21 of the front containment wall 4B and holds the insert 18 in place.

Figure 19:
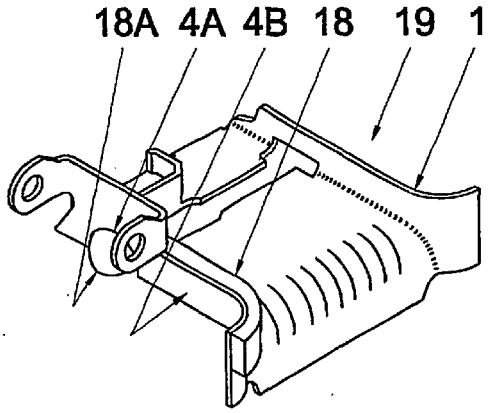
FIG. 19 shows a further variant of the training feed tray of FIG. 10A wherein the training feed tray and training cartridge guide surface is depicted in perspective view as being of one monolithic piece (i.e., not two pieces attached together as in FIG. 10A).

FIG. 19 shows a monolithic training tray 22 with the training cartridge guide surface 18D formed as part of the tray 22 itself.

Training feed tray 19 of FIG. 16 has been tested successfully many times in an M249 machinegun converted to fire reduced-energy training cartridges as represented by U.S. Pat. No. 5,359,937. It is also adaptable to other similar weapons, including the FN minimi.

CONCLUSION

The foregoing has constituted a description of specific embodiments showing how the invention may be applied and put into use. These embodiments are only exemplary. The invention in its broadest, and more specific aspects, is further described and defined in the claims which now follow. These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which and exclusive property or privilege is claimed are defined as follows:

1. A feed tray for supplying belt ammunition training cartridges to an automatic firearm suited to fire standard cartridges of standard length comprising:

(a) a tray support surface (b) forward and rearward ammunition containment side walls mounted along opposite sides of said tray support surface (c) a loading port orifice at the end of the forward containment wall through which cartridges may be advanced characterized by a feed lip with a guide surface positioned above the loading port orifice along the forward containment wall which feed lip protrudes outwardly from the forward containment wall to downwardly guide training ammunition passing through the loading port orifice, whereby training ammunition of shorter length than standard length ammunition being fed through such tray and outwardly through the loading port orifice is guided in its advancement through said orifice by the feed lip.

2. A feed tray as in claim 1 wherein the forward containment wall has an outer side characterized in that the guide surface of the feed lip extends rearwardly from the outer side of the forward containment wall to provide an extended guide surface.

3. A feed tray as in claim 1 characterized by a training cartridge containment surface located along the inner side of the forward containment wall to reduce the distance between said containment walls to substantially the length of training ammunition cartridges to be passed through said tray for firing and thereby exclude the loading of standard length cartridges.

4. A tray as in claim 3 wherein the forward ammunition containment side wall has an upper edge and the insert comprises a groove positioned and dimensioned to receive the upper edge of said containment side wall to fix the insert in place on the feed tray.

5. A tray as in claim 2 comprising:

(a) a loading port orifice at the end of the forward containment wall through which cartridges may be advanced (b) a feed lip positioned above the loading port orifice along the forward containment wall, outwardly from the tray support surface whereby ammunition being fed through such tray and outwardly through the loading port orifice is guided in its advancement through said orifice by the feed lip.

6. A tray as in claim 5 wherein the feed lip is carried by and supported in its position by the insert.

7. A feed tray as in claim 2 characterized by a training cartridge containment surface located along the inner side of the forward containment wall to reduce the distance between said containment walls to substantially the length of training ammunition cartridges to be passed through said tray for firing and thereby exclude the loading of standard length cartridges.

8. A tray as in claim 7 wherein the feed lip is carried by and supported in its position by the insert.

9. A tray as in claim 4 comprising:

(a) a loading port orifice at the end of the forward containment wall through which cartridges may be advanced (b) a feed lip positioned above the loading port orifice along the forward containment wall, outwardly from the tray support surface whereby ammunition being fed through such tray and outwardly through the loading port orifice is guided in its advancement through said orifice by the feed lip.

10. A tray as in claim 6 wherein the feed lip is carried by and supported in its position by the insert.

* * * * *